US005871107A

United States Patent [19]

Johnson et al.

[11] Patent Number: 5,871,107

[45] Date of Patent: Feb. 16, 1999

[54] VERSATILE SPICE KEEPER

[76] Inventors: Merlyn B. Johnson, 2904 Joan La., Billings, Mont. 59102; Brycelyn B. Johnson, 11000 Queenswick Ct., Oklahoma City, Okla. 73162; Kimberly D. Halverson, 5607 Vermillion Rd., Billings, Mont. 59105

[21] Appl. No.: 845,667

[22] Filed: Apr. 28, 1997

[51] Int. Cl.[6] ..... A47F 7/00

[52] U.S. Cl. ..... 211/104; 211/13.1

[58] Field of Search ..... 211/104, 79, 70.01, 211/96, 99, 13.1

[56] References Cited

U.S. PATENT DOCUMENTS

| | | | |
|---|---|---|---|
| 4,485,928 | 12/1984 | Staashelm | 211/104 X |
| 4,760,926 | 8/1988 | Iuni | 211/104 X |
| 5,058,846 | 10/1991 | Close | 211/104 X |
| 5,671,850 | 9/1997 | Basala | 211/104 X |

*Primary Examiner*—Alvin C. Chin-Shue
*Assistant Examiner*—Sarah Purol

[57] ABSTRACT

A versatile spice keeper for use with spices contained in cans or bottles, comprising two pull down hinges, a sheet metal tray with or without attached magnetic tape, sheet metal devices of two different lengths with or without attached magnetic tape, the devices being bent to ninety degrees conformed to the shape of the capital letter el (L), the magnetic tape being attached to the devices using double sided foam adhesive material attached to the base of each (L) shaped device, the tray being rectangular and designed with four sides being bent upright to ninety degrees, the four sides being of equal height, each lateral side having an inward ninety degree bend that contacts the posterior surface of the front side of the tray, a screw being inserted through a hole in each bend of the lateral sides and a hole in the front side attaching such sides to the back side of the wooden face of the tray, as an option, the tray with or without a strip of magnetic tape attached to the front surface of the back side of the tray, the tape being attached with double sided foam adhesive material, the lower brackets of the two pull down hinges being attached to each back corner of the tray, the upper brackets of the pull down hinges being attached to the underside of a kitchen wall cabinet.

1 Claim, 3 Drawing Sheets

VERSATILE SPICE KEEPER

This invention relates to a novel assembly that fits within the perimeters of the underside of a kitchen wall cabinet. The assembly consists of two pull down hinges and sheet metal tray with or without attached magnetic tape and el (L) shaped sheet metal devices of two different lengths with or without attached magnetic tape. In addition, double sided foam adhesive material is attached to the base of each sheet metal device. Furthermore, this invention allows the consumer to design and construct a versatile spice keeper that will accommodate spices in cans or bottles of various sizes and shapes or a combination of both. For example, the storage area of the tray can be designed by the consumer using a combination of different (L) shaped metal devices. Combining shorter (L) shaped metal pieces with a longer metal piece allows storing spice containers of different sizes promoting maximum utilization of the available tray space. One part of the tray may be designed to accommodate the average sized spice bottles while another part may be designed for the smaller sized spice bottles and yet another part just for spice cans. In addition, the consumer has an option of using the metal devices with attached magnetic tape. The magnetic metal devices work very well with spices in cans or bottles (with tin lids). Such spice containers are maintained in position by magnetic adhesion created between the tin and the magnetic tape. The magnetic adhesion prevents the containers from moving around on the tray maintaining the labels on the containers in a readable position. In addition, selecting this option would be beneficial when mounting a spice keeper in a travel trailer or motor home. The upper brackets of the pull down hinges attach the spice keeper to the underside of the kitchen wall cabinet. The action of the pull down hinges allows the assembly to be extended into a downward and outward position from the underside of the wall cabinet displaying the spice containers at a 45 degree angle allowing easy removal and replacement of the containers. The pull down hinges also allow the tray to be returned from its extended position to a flat compact position within the underside perimeters of the wall cabinet. The assembly can be made in various sizes of length and horizontal depth to fit within those perimeters of different sized kitchen wall cabinets.

Spice containers are stored in a number of ways. For example, spices in cans and/or bottles are stored on a shelf in a wall cabinet, in a drawer of a floor cabinet, in spice racks hung on walls or on the back side of cabinet doors and in various receptacles placed on kitchen counter tops. Storing spices on a cabinet shelf takes up precious shelf space. In addition, trying to find a particular spice on a shelf with numerous other spice containers is cumbersome since one has to lift or move the containers around until the selection is found. Storing spices in a drawer takes up precious drawer space. Also, storing spice containers in a drawer can be troublesome since the containers may be difficult to remove and replace. In addition, reading labels on containers placed in a drawer may not be easy especially when containers are placed in a vertical position. Built-in spice racks on the back of a cabinet door reduces shelf space since the shelves must be reduced in depth to accommodate the rack. Storing spices in various receptacles placed on a kitchen counter top can be a problem since that precious work area is needed for food preparation.

This invention mounted within the underside perimeters of a kitchen wall cabinet eliminates the frustrations of storing spices on a kitchen cabinet shelf, in a kitchen cabinet drawer on kitchen counter tops and in racks hung on kitchen cabinet doors or walls. In addition, this invention provides a simple means for the consumer to design and construct a versatile spice keeper that will organize a variety of spice containers efficiently and effectively allowing the containers to be removed and replaced easily and quickly. Furthermore, shelf, drawer and counter space become available for other kitchen uses.

Other benefits and advantages of the invention will be apparent from the following descriptions and accompanying drawings in which.

Figure 1:
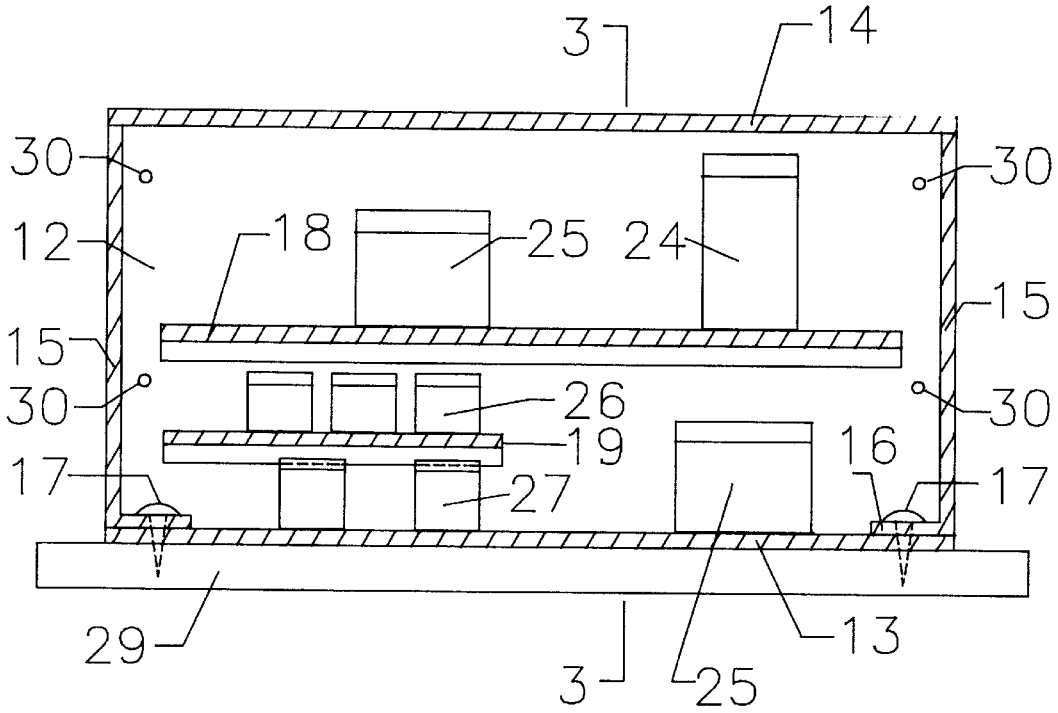
FIG. 1 is a top view of the tray of the invention including el (L) shaped metal devices without attached magnetic tape.
Figure 2:
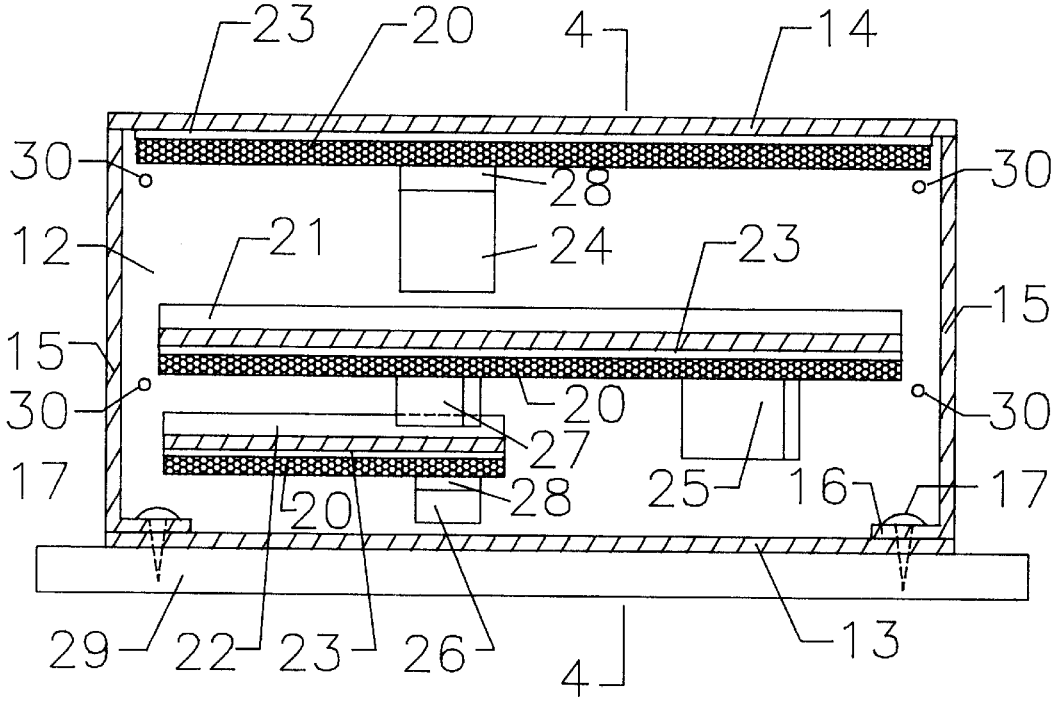
FIG. 2 is a top view of the tray of the invention including el (L) shaped metal devices with attached magnetic tape.
Figure 3:
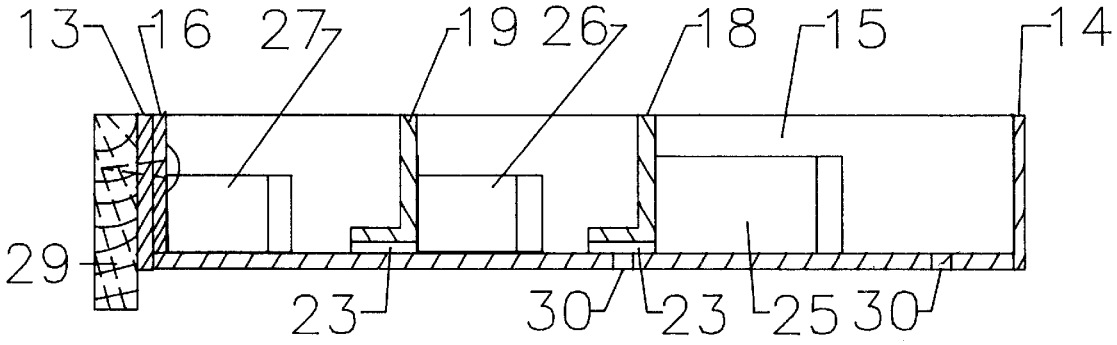
FIG. 3 is a sectional view taken along line 3—3 of FIG. 1.
Figure 4:
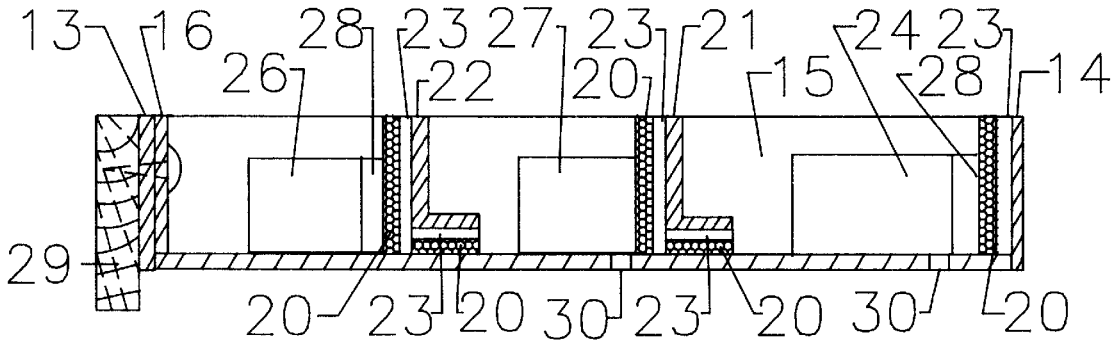
FIG. 4 is a sectional view taken along line 4—4 of FIG. 2.
Figure 5:
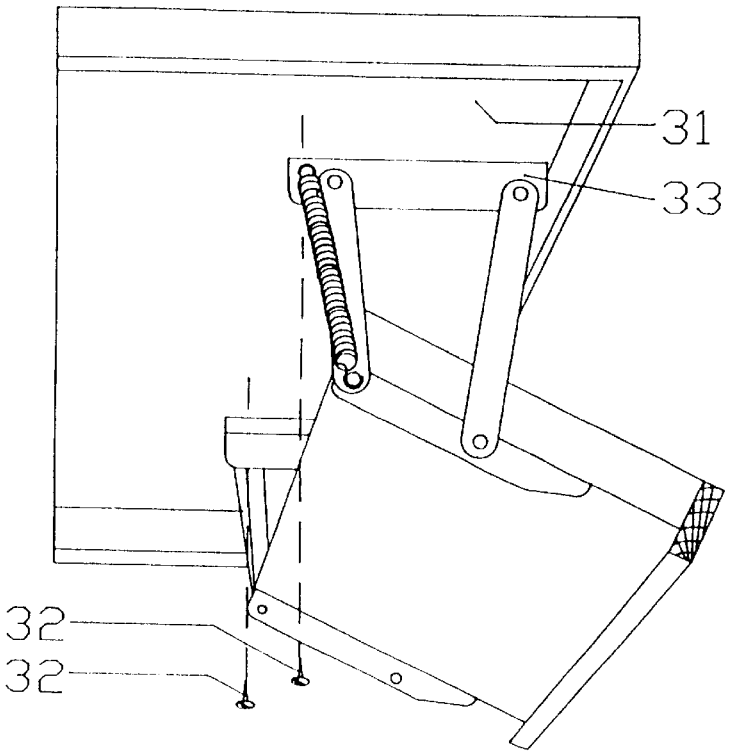
FIG. 5 is a perspective view of the pull down hinges attached to the underside of a kitchen wall hung cabinet. The hinges are fully extended placing the tray of the invention in its most accessible position.
Figure 6:
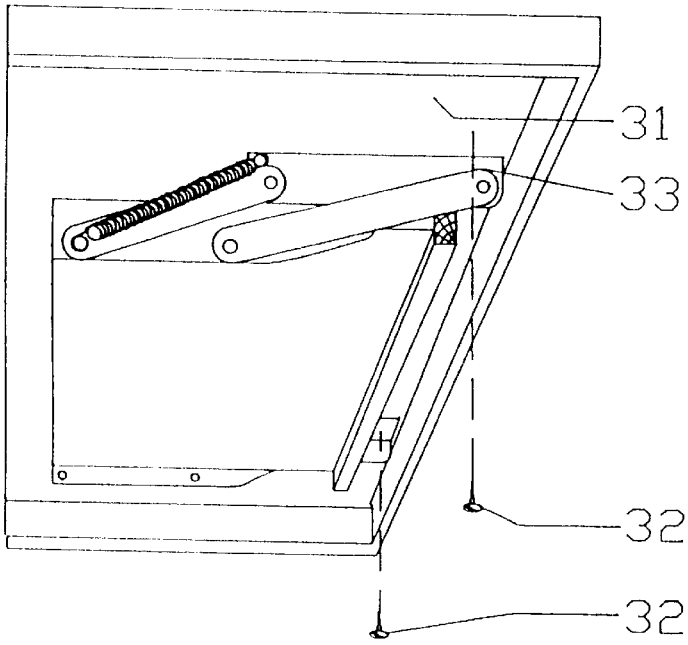
FIG. 6 is a perspective view of the pull down hinges fully retracted placing the tray of the invention in its most inaccessible position.

As shown in the drawings, a tray 12 is constructed of sheet metal. The front 13 and back 14 sides of the tray including both lateral sides 15 are bent upright to ninety degrees. All sides are of equal height. The anterior end of each lateral side has a right angle bend 16 that contacts the posterior surface of the front side of the tray 13. Two sheet metal screws 17 are used to connect both lateral sides 15 and front side 13 of the tray to the posterior surface of the wooden facing 29.

Two el (L) shaped metal devices 18 and 19 of different lengths with attached magnetic tape 20 have double sided foam adhesive material 23 attached to their base. The devices are fastened easily to the tray simply by removing the wax paper from the adhesive material and press firmly onto the tray. The larger metal device 18 is fastened to the tray on a straight line parallel to and between the front side 13 and the back side 14 of the tray. Positioning the metal device as such will accommodate the average sized spice bottles and/or cans made available to the consumer by different manufacturers. The shorter metal device is fastened to the tray parallel to and between the metal device 18 and the front side 13 of the tray. Positioning the shorter metal device as such will accommodate the smaller spice bottles and/or cans. The metal devices provide a ledge for holding the various sizes and shapes of spice containers. For example, the larger spice bottles 24 and/or cans 25 may be placed comfortably on the ledge of the larger metal device and/or on the posterior surface of the front side 13 of the tray. Additionally, the smaller spice bottles 26 and/or cans 27 may be placed on the ledge of the smaller metal device and/or on the posterior surface of the front side of the tray. Also, the consumer can promote the versatility of the spice keeper by fastening two or more smaller metal devices 19 to the tray expanding the tray's holding capacity of the smaller spice containers.

The consumer has the options of choosing the metal tray with magnetic tape 20 attached to the anterior surface of the back side 14 of the tray and metal devices 21 and 22 with attached magnetic tape 20. The magnetic tape is attached to the devices using double sided adhesive material. Such devices are fastened to the tray in the same manner as the metal devices without the magnetic tape. The larger sized spice bottles 24 and smaller spice bottles 26 with tin lids 28 are held in position by the magnetic adhesion created between the tin lid and the magnetic tape. The tin component of the larger spice cans 25 and smaller cans 27 create a similar magnetic adhesion with the magnetic tape. The spice bottles with tin lids placed in the tray with labels in a readable position will be maintained in that position promoting their quick identification and can be removed and replaced easily and quickly. If desired, the magnetic devices can be used in conjunction with the non magnetic devices expanding further the versatility of this novel spice keeper invention.

The tray is connected to the lower brackets of the pull down hinges 33 using four stove bolts and nuts inserted through the holes of the brackets and the aligning holes 30 in the base of the tray.

The upper brackets of the pull down hinges are attached to the underside of a wall hung kitchen cabinet 31 using four screws 32 inserted through the holes of the upper brackets.

What is claimed is:

1. A versatile spice keeper comprising two pull down hinges, a sheet metal tray and el (L) shaped sheet metal devices of two different lengths, further defined by:

a) a tray made of sheet metal with front, back and lateral sides bent upwards to ninety degrees and all sides being of similar height; having the option of magnetic tape attached to the anterior surface of the back side of the tray, a wooden facing board attached to the anterior surface of the front side of the tray;

b) sheet metal devices of two different lengths bent to ninety degrees conforming to the shape of the capital letter el (L), having the option of choosing or not choosing magnetic tape being attached to the longest vertical surface of the metal devices, the magnetic tape being attached using double sided adhesive tape, further including double sided foam adhesive material attached to the base of the (L) shaped devices providing the means of fastening the magnetic tape to the tray.

* * * * *